United States Patent [19]

Iwamoto

[11] Patent Number: 4,487,051

[45] Date of Patent: Dec. 11, 1984

[54] PRESS APPARATUS

[75] Inventor: Kuniharu Iwamoto, Toyota, Japan

[73] Assignee: Toyota Jidosha Kabushiki Kaisha, Toyota, Japan

[21] Appl. No.: 450,803

[22] Filed: Dec. 17, 1982

[30] Foreign Application Priority Data

Jun. 17, 1981 [JP] Japan ..... 56-089317[U]

[51] Int. Cl.[3] ..... B21D 11/04

[52] U.S. Cl. ..... 72/312; 72/315; 72/461; 72/381

[58] Field of Search ..... 72/481, 483, 461, 36, 72/312, 313, 314, 315, 381

[56] References Cited

U.S. PATENT DOCUMENTS

| | | | |
|---|---|---|---|
| 1,764,318 | 6/1930 | Kruse | 72/313 |
| 1,787,151 | 12/1930 | Groehn | 72/383 |
| 2,206,307 | 7/1940 | Schneider | 72/313 |
| 2,271,107 | 1/1942 | Swangren | 72/313 |
| 2,800,814 | 7/1957 | Lewis | 72/361 |
| 3,628,368 | 12/1971 | Cvacho | 72/361 |
| 3,812,695 | 5/1974 | Roch | 72/36 |

FOREIGN PATENT DOCUMENTS

| | | | |
|---|---|---|---|
| 266708 | 4/1970 | U.S.S.R. | 72/312 |

*Primary Examiner*—Daniel C. Crane
*Assistant Examiner*—David B. Jones
*Attorney, Agent, or Firm*—Cushman, Darby & Cushman

[57] ABSTRACT

A press apparatus having a lower die, an upper die and a lateral pressing cam mechanism adapted to apply a lateral pressure to a work clamped between the upper and lower dies. The lateral pressing cam mechanism includes a slidable cam adapted to be slided towards the clamped work through cooperation with a fixed cam fixed to an actuator. The apparatus has a guide mechanism pivotally secured at its one end to a supporting member extended from the lower die and provided at its other end with a guide portion for locating the work on the lower die. A mutually cooperating cam is provided on the upper portion of the slidable cam and on the central portion of the guide mechanism, so that the guide mechanism is swung from the path of the slidable cam as it is moved towards the work clamped between the two dies.

4 Claims, 4 Drawing Figures

PRESS APPARATUS

The present invention relates to a press aparatus having a lateral pressing cam mechanism.

The lateral pressing cam mechanism has a fixed cam which may be lowered substantially simultaneously with the lowering of an upper die, and a laterally slidable cam adapted to be moved by engagement with the fixed cam. In operation, a workpiece placed on a lower die is clamped between the lower die and the upper die as the latter is moved downward, and, almost simultaneously with the downward movement of the upper die, the fixed cam may be moved downward to engage the slidable cam to move the latter laterally perform work on the workpiece by means of a bending edge secured to the slidable cam. It is essential that the workpiece held by the lower die is placed correctly in a proper position on the lower die.

Conventional press apparatus typically use blocks, plates or the like at the front, rear and both lateral sides of the die for correctly locating the workpiece. The provision of such blocks or plates, however, causes a problem when the press apparatus incorporates a lateral pressing cam mechanism. Namely, in such a press apparatus, the position of block or plate may not hamper the path of the movable part of the cam mechanism, otherwise the cam may not reach the workpiece. Therefore, it becomes difficult to correctly locate the workpiece in relation to the die. FIG. 4 shows a case where a plate A is used in place of a block, and the plate A has to be positioned away from the workpiece W in order to allow space for operation of the cam. Accordingly, the work W maybe undesirably displaced as shown by the dot-dash line. Thus, in prior art devices, the correct location of the workpiece was often unachieved.

SUMMARY OF THE INVENTION

The present invention shows at least these problems of the prior art by providing a press apparatus having a lateral pressing cam mechanism with a guide means for accurately locating the workpiece at the beginning of the pressing operation. The guide means is then moved so as not to interfere with the cam nor with upper and lower dies during machining by the lateral pressing cam mechanism, thereby eliminating the above-described problems of the prior art.

More specifically, according to the invention, the guide means for locating the workpiece is provided with a cam means which is adapted to cooperate with the slidable cam of the lateral pressing cam mechanism in such a manner that, when the lateral pressing cam means operates, the guide means is moved away from the workpiece position on the lower die. At the beginning of the pressing operation, the guide means is positioned in close proximity of the workpiece to correctly register the workpiece but, when the lateral pressing cam mechanism starts to operate, the guide means is moved away from the workpiece to permit the slidable cam to reach the workpiece. According to this arrangement, it is possible to temporarily dispose the guide means at a position where the lateral pressing cam would be blocked in the conventional press apparatus, so that the workpiece can be stably and correctly located to ensure high precision press work.

Other objects, features and advantages of the invention will become clear from the following description of the preferred embodiment taken in conjunction with the accompanying drawings.

A preferred embodiment of the invention will now be described with reference to the accompanying drawings.

Figure 1:
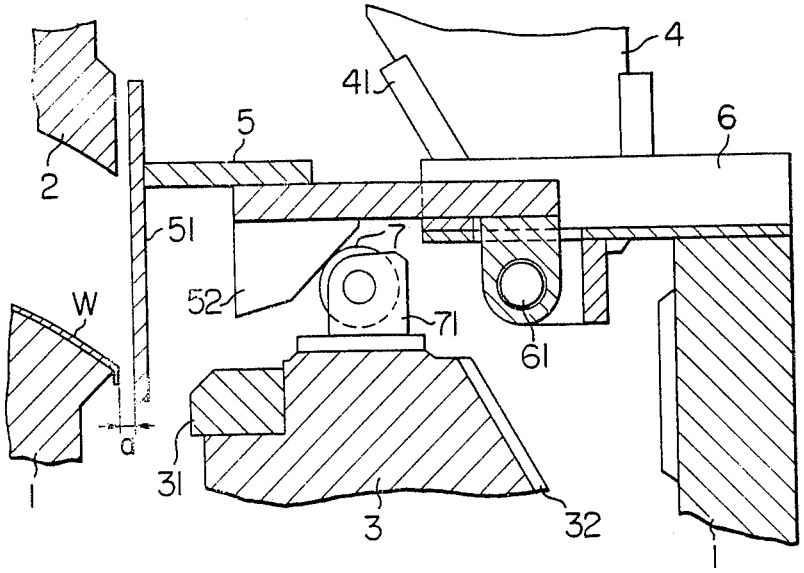
FIG. 1 is a sectional view showing a part of a press apparatus in accordance with an embodiment of the invention.
Figure 2:
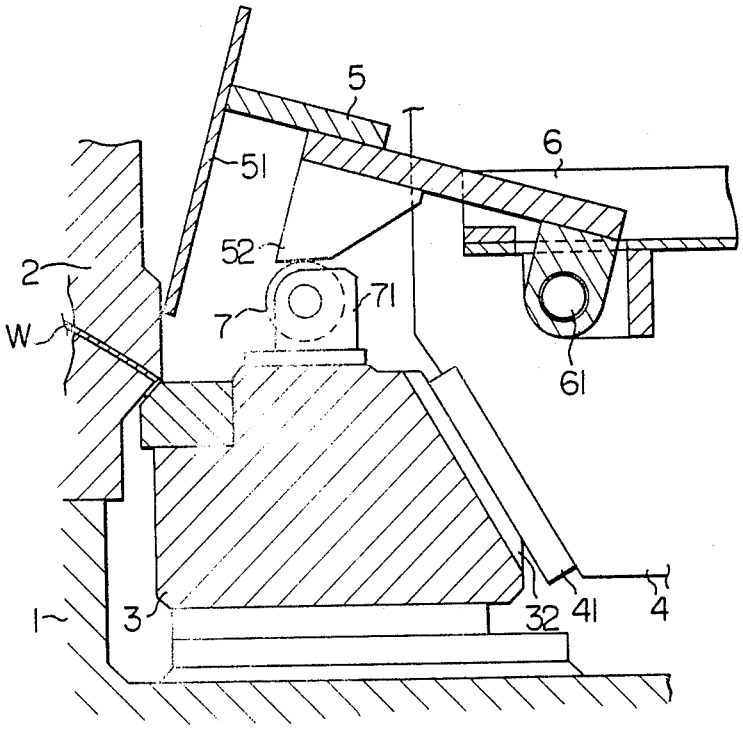
FIG. 2 is a sectional view of the present press apparatus having completed a pressing operation.
Figure 3:
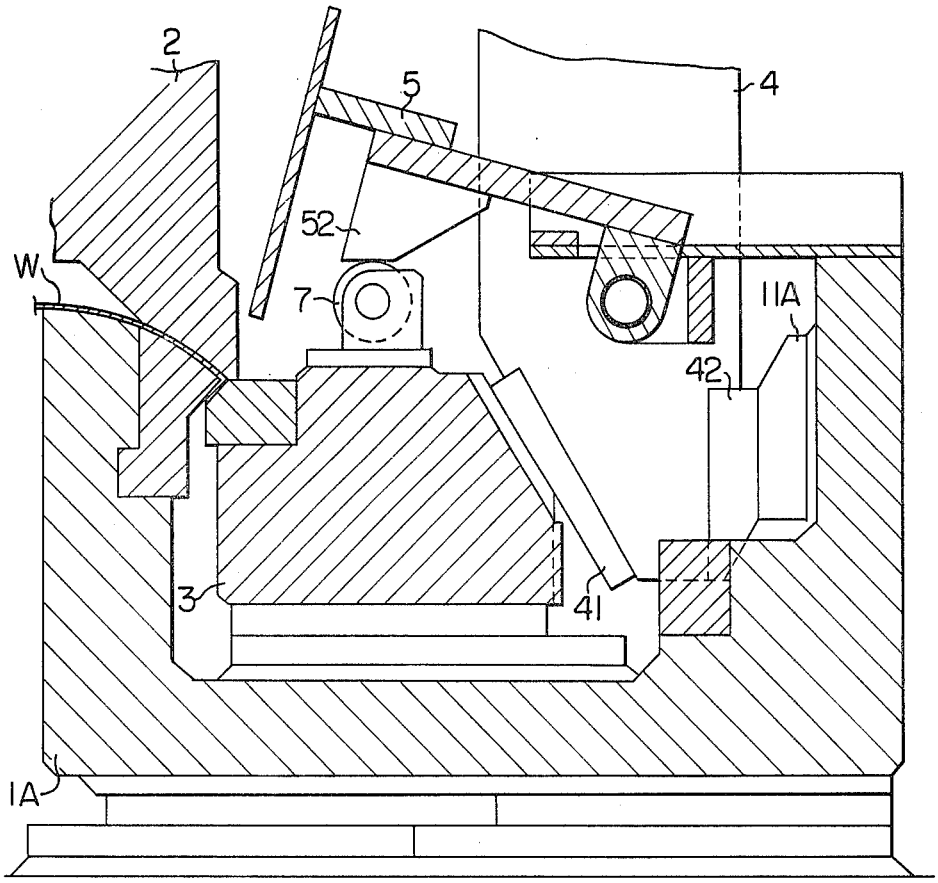
FIG. 3 is a sectional view of another embodiment.
Figure 4:
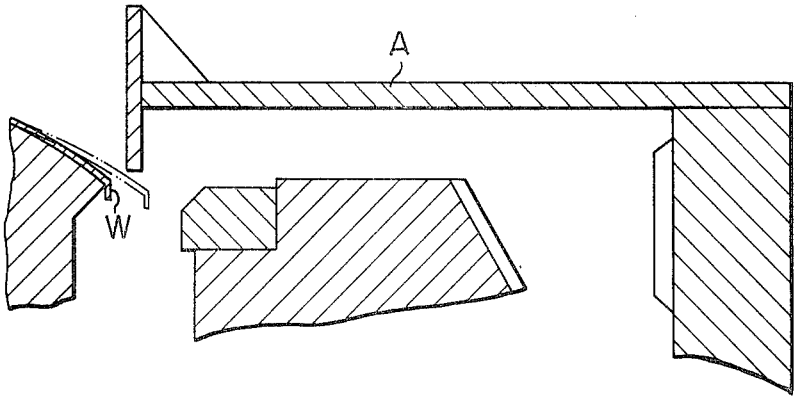
FIG. 4 PRIOR ART
FIG. 4 is a sectional view illustrating the positioning of a work by means of plates in a conventional press apparatus.

FIGS. 1 to 3 illustrate a press apparatus of the invention in which bending of a workpiece is effected by a lateral pressing cam mechanism. Referring to these Figures, a workpiece W has been transported and placed on a lower die 1. An upper die 2 disposed above the lower die 1 is adapted to be moved up and down, i.e. towards and away from the lower die 1, by the operation of an actuator (which is not shown). A laterally slidable cam 3, constituting a part of the lateral pressing cam mechanism, is disposed at the right side of the lower die 1 as viewed in FIG. 1, for sliding movement in the lateral directions. The slidable cam 3 is provided at its one side closer to the lower die 1 with a bending edge 31 for effecting bending of the workpiece W and at its other side with a cam surface 32. The slidable cam 3 is always biased to the right as viewed in the drawings by a biasing means which is not shown. A fixed cam 4 is disposed above the slidable cam 3 and is connected to an actuator (which is not shown) so as to be moved up and down by the operation of the actuator. The fixed cam 4 has a cam surface 41 opposing the cam surface of the slidable cam 3. A single common actuator may be used for both the upper die 2 and the fixed cam 4, or, alternatively, separate actuators may be used for the upper die 2 and the fixed cam 4 independently.

A reference numeral 5 denotes a guide means provided at its one end with a guide portion 51 for registering the work and rotatably carried at its other end by a shaft 61 of a supporting member extended from the lower die 1. A cam 52 is attached to the central portion of the guide means 5. The cam 52 is adapted to be contacted by a roller 7 rotatably carried by a holding member 71 mounted on the upper surface of the slidable cam 3.

The press apparatus of the invention constructed as described above operates in the following manner.

As the first step, the guide portion 51 of the guide means 5 is brought to a position near the end of the lower die 1 and the workpiece W is placed on the lower die 1 while being guided by the guide portion 51. Then, the workpiece W is correctly registered at the proper position by the guide means 5. Thereafter, the pressing is commenced so that the upper die 2 and the fixed cam 4 are moved downward substantially in synchronism by the operation of the actuators or actuator. Then, as the cam surface 41 of the fixed cam 4 is brought into contact with the cam surface 32 of the slidable cam 3, the slidable cam 3 is moved to the left as shown in the drawing overcoming the force of the biasing means (which is not shown). As a result of the leftward movement of the slidable cam 3, the roller 7 secured to the upper surface of the slidable cam 3 starts to roll along the surface of the cam 52 thereby lifting the cam 52. In consequence, the guide means 5, which has located the workpiece W, is pivoted upward around the axis of the shaft 61 on the supporting member 6. Almost concurrently with the upward movement of the guide means 5, the upper die 2 reaches its downward stroke end to clamp the work W in cooperation with the lower die 1. Then, as the slidable cam 3 is further moved to the left (as viewed in the drawings), the guide means 5 is swung upwardly (as shown in FIGS. 2), so that the slidable cam 3 can effect the bending of the workpiece W without being blocked by the guide means 5. After the completion of the pressing and bending operation, the upper die 2 and the fixed cam 4 are moved upwardly so that the slidable cam is returned rightwardly to the initial position by the force of the biasing means (which is not shown). As the slidable cam 3 is returned to the initial position, the guide means 5 is reset to the work locating position to locate the next workpiece W. Then, the next workpiece is pressed and bent in the manner explained hereinbefore.

FIG. 3 shows another embodiment of the invention in which, in order to further diminish the gap a between the guide means 5 and the workpiece W, means are provided for moving the lower die A laterally. More specifically, in the embodiment shown in FIG. 3, a cam surface 42 is provided on the opposite side of the fixed cam 4 to the cam surface 41, while the lower die 1A is provided with a cam surface 11A opposing to the cam surface 42. A guide means 5 is secured through a supporting member 6 to the lower die 1A, as in the case of the first embodiment. The lower die 1A is normally biased to the left as viewed in the drawings by a biasing means (which is not shown).

In operation, as the fixed cam 4 and the upper die 2 are lowered, the cam surface 11A of the lower die 1A is engaged and pressed by the cam surface 42 of the fixed cam 4, so that the lower die 1A is moved to the right as viewed in the drawings. As a result, the guide means 5 is moved to the right while being rotated upward. It is thus possible to arrange the guide means 5 in such a manner as to avoid interference with the upper die 2 and the slidable cam 3. The operation of the slidable cam 3 and the upper die 2 is materially identical to that in the first embodiment.

Although the invention has been described specifically for a presently preferred embodiment, it is to be noted that the described embodiment is only illustrative and various changes and modification may be imparted thereto without departing from the scope of the invention which is limited solely by the appended claims.

What is claimed is:

1. A press apparatus, comprising:

a lower die for receiving a workpiece;

an upper die movable in direction towards said lower die to clamp said workpiece in cooperation with said lower die;

a lateral pressing cam mechanism including a fixed cam movable in a single plane parallel to said upper die, and a slidable cam in cooperation with said fixed cam movable substantially laterally with respect to the movement of the upper die as said fixed cam is moved, thereby effecting work on said workpiece clamped between said upper and lower dies;

guide means for selectively registering said workpiece on said lower die prior to said slidable cam beginning work on said workpiece, said guide means having at its one end a guide portion for registering said workpiece and a pivot at its other end mounted on a supporting member extending from said lower die; and mutually cooperating cam means provided on a portion of said slidable cam and a portion of said guide means, said mutually cooperating cam means causing said guide means to be pivoted on said pivot as said slidable cam undergoes movement.

2. A press apparatus as in claim 1, wherein:

said mutually cooperating cam means constitutes a mounted roller for the portion associated with said slidable cam and an angled surface for the portion associated with said guide means, whereby operation of said mutually cooperating cam means prevents said guide means from blocking said slidable cam from performing work on aid workpiece.

3. A press apparatus as in claim 2, wherein:

said upper die and said fixed cam are movable in tandem by a single actuator.

4. A press apparatus as in claim 1, wherein: said upper die and said fixed cam are movable independently by separate actuators.

* * * * *